US011655590B1

(12) United States Patent
Gerry, Jr.

(10) Patent No.: US 11,655,590 B1
(45) Date of Patent: May 23, 2023

(54) THROUGH-AIR APPARATUS WITH COOLING SYSTEM

(71) Applicant: Valmet AB, Sundsvall (SE)

(72) Inventor: Stanley M. Gerry, Jr., Gray, ME (US)

(73) Assignee: Valmet, AB, Sundsvall (SE)

( * ) Notice: Subject to any disclaimer, the term of this patent is extended or adjusted under 35 U.S.C. 154(b) by 0 days.

(21) Appl. No.: 17/588,526

(22) Filed: Jan. 31, 2022

(51) Int. Cl.
*D21F 5/18* (2006.01)
*D21F 7/12* (2006.01)

(52) U.S. Cl.
CPC ..... *D21F 5/182* (2013.01); *D21F 7/12* (2013.01)

(58) Field of Classification Search
CPC .. D21F 5/182; D21F 7/12; D04H 3/11; D04H 3/16; B29K 2105/06; D06B 5/08; D06C 7/00; D06C 29/00; D06C 7/02; F26B 13/00; F26B 13/16; F26B 21/004; F26B 23/00
See application file for complete search history.

(56) References Cited

U.S. PATENT DOCUMENTS 10,161,070 B2 12/2018 Weigert et al.
2005/0072023 A1* 4/2005 Hada ..... D21F 5/182 34/633
2016/0312391 A1* 10/2016 Weigert ..... D04H 1/54

FOREIGN PATENT DOCUMENTS

DE 102007053030 A1 * 5/2009 ..... D04H 1/49
JP 3365520 B2 1/2003

* cited by examiner

*Primary Examiner* — Eric Hug
*Assistant Examiner* — Matthew M Eslami
(74) *Attorney, Agent, or Firm* — Pierce Atwood LLP

(57) ABSTRACT

A through-air apparatus for drying, curing, or bonding paper or non-woven products is provided. The apparatus includes a through-air roll configured for rotational movement about a first axis, where the through-air roll is configured to carry a web. The apparatus also includes a hood at least partially enclosing the through-air roll, and a cooling system positioned adjacent the through-air roll. The cooling system is configured to provide cool air to a web as the web leaves the through-air roll, and all of the cooling system is external to the through-air roll.

20 Claims, 8 Drawing Sheets

THROUGH-AIR APPARATUS WITH COOLING SYSTEM

FIELD OF THE INVENTION

The invention relates, in part, to a through-air apparatus for manufacturing web products, where the through-air apparatus includes a system to cool the web.

BACKGROUND

"Through air technology" is a term used to describe systems and methods enabling the flow of air through a paper or nonwoven web for the purpose of drying or bonding fibers or filaments. Examples include the drying of nonwoven products (e.g., tea bags and specialty papers); drying and curing of fiberglass mat, filter paper, and resin-treated nonwovens; thermobonding and drying of spunbond nonwovens; drying hydroentangled webs; thermobonding geotextiles with or without bicomponent fibers; drying and curing interlining grades; and thermobonding absorbent cores with fusible binder fibers. The drying of tissue paper is also another application of through air technology.

Systems and methods related to through-air drying are commonly referred to through the use of the "TAD" acronym. Systems and methods related to through-air bonding are commonly referred to through the use of the "TAB" acronym.

A through-air apparatus generally includes a rigid air-permeable web-carrying structure, typically called a through-air roll. A web is placed on the through-air roll, and as the through-air roll rotates, a fan may blow air through the wall of the through-air roll to treat the web. The through-air roll typically has a plurality of openings to permit the air to pass through the roll.

SUMMARY OF THE INVENTION

According to one embodiment, a through-air apparatus for drying, curing, or bonding paper or non-woven products is provided. The apparatus includes a through-air roll configured for rotational movement about a first axis, and the through-air roll is configured to carry a web. The apparatus also includes a hood at least partially enclosing the through-air roll, and a cooling system positioned adjacent the through-air roll. The cooling system is configured to provide cool air to a web as the web leaves the through-air roll, and all of the cooling system is external to the through-air roll.

DETAILED DESCRIPTION

The present disclosure is directed to a through-air apparatus configured to manufacture various products, such as paper/tissue and/or nonwoven webs. The through-air apparatus may be configured for drying, curing, or bonding, and one of ordinary skill in the art would recognize that the through-air apparatus may be configured as a through-air dryer (TAD) and/or a through-air bonder (TAB), depending on the context in which the apparatus is used. One of ordinary skill in the art will also recognize that the through-air apparatus may be used to make various web products that are rolled in their finished end product form. It should also be recognized that the product may not be rolled and/or may be cut into a finished end product. Furthermore, one of ordinary skill in the art will also recognize that the through-air apparatus may be configured to make various products, including, but not limited to various films, fabric, or other web type material, and the apparatus may be used for various processes that may include mass transfer, heat transfer, material displacement, web handling, and quality monitoring, including, but not limited to drying, thermal bonding, sheet transfer, water extraction, web tensioning, and porosity measurement.

As set forth in more detail below, the through-air apparatus includes a through-air roll configured to rotate relative to another portion of the apparatus. A web is placed on the through-air roll, and as the web rotates, a fan may blow air through the wall of the through-air roll to treat the web. The through-air roll typically has a plurality of openings to permit the air to pass through the roll.

In one embodiment, a web (i.e. product) is typically in a sheet-form and is partially wrapped around the cylindrical outer surface/shell of the through-air roll. The web is wrapped about a portion of the roll ranging from, for example, 90° to 360°, and typically between 180°-300° around the roll. The cylindrical wall of the through-air roll typically has a plurality of openings configured for air to pass through. A fan/blower may be used to circulate the air across the product, and the through-air roll is typically positioned within a hood to optimize the air flow characteristics. As the product travels with the rotating shell through the active zone of the apparatus, the fan/blower circulates air through the wall of the cylindrical shell to treat the product. A heater may be provided so that heated air circulates through the through-air roll.

Figure 1:
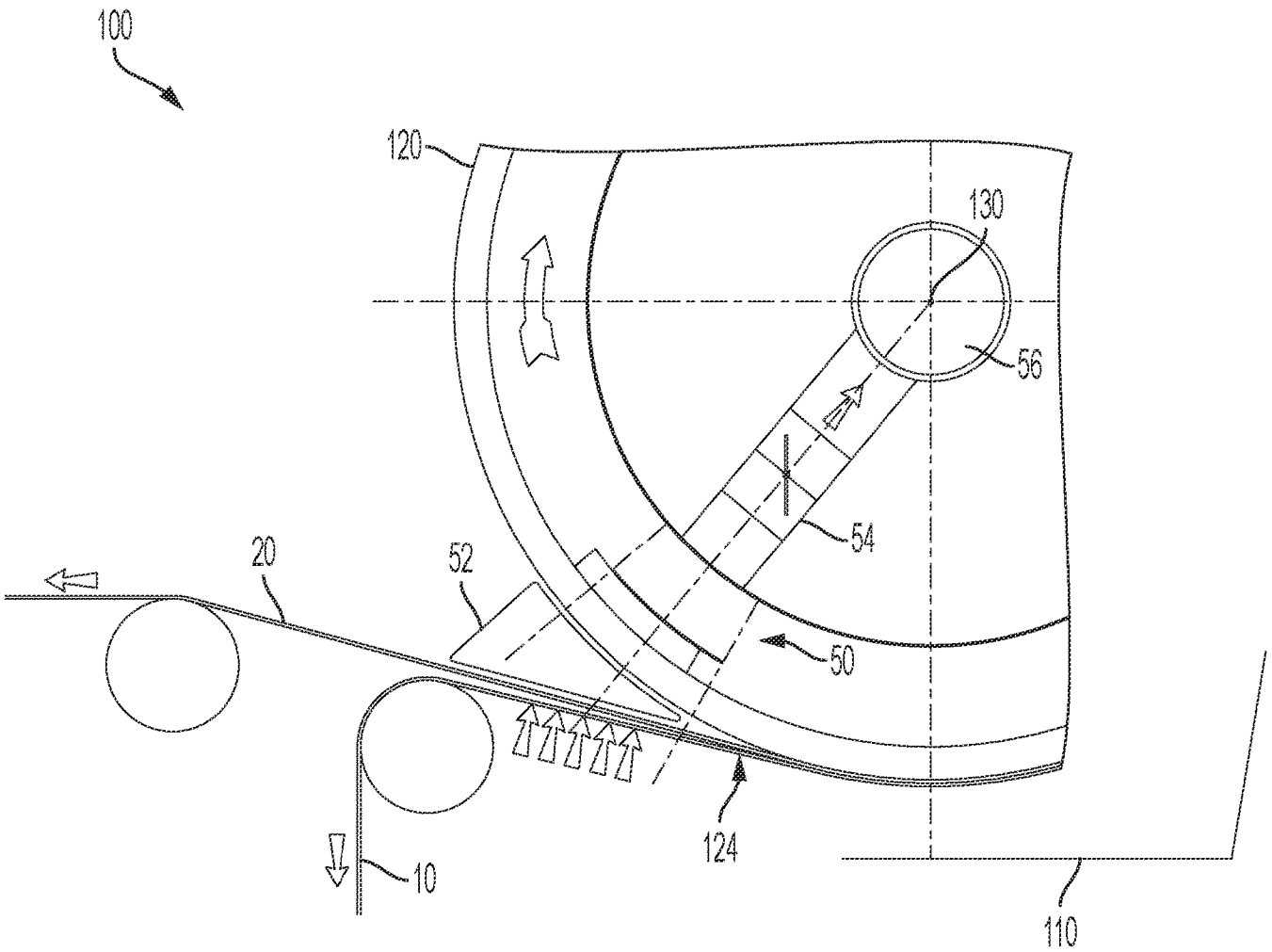
Figure 1 (Prior Art)
FIG. 1 is a schematic diagram of a prior art through-air apparatus.

FIG. 1 illustrates a portion of a conventional prior art through-air apparatus 100. As shown, the through-air apparatus 100 includes a though-air roll 120 that is configured to rotate about a first axis 130. The roll 120 is configured to carry a web 10. In this embodiment, the roll 120 and web 10 rotate in a clockwise direction about the first axis 130. As shown, a carrying wire 20 may be configured to extend around at least a portion of the through-air roll 120 to carry the web 10. Also, a hood 110 at least partially encloses the through-air roll 120.

As shown in FIG. 1, the conventional through-air apparatus 100 includes a cooling system 50 that is configured to cool the web 10 as the web leaves the through-air roll 120.

A cooling system 50 may be used to set the fiber bonds within the web 10. It is generally desirable to cool the web 10 as soon as the bonds have been formed and as close to the detachment point 124 (i.e. tangent point) where the web leaves the through-air roll 120. A cooling system 50 may also be used for a clean separation of the web 10 from the carrying wire 20.

In this prior art apparatus 100, the cooling system 50 includes a first duct component 52 adjacent the through-air roll 120 and a second duct component 54 inside of the through-air roll 120. As shown by the arrows that represent cool air flow through the cooling system in FIG. 1, the conventional cooling system 50 is configured so that cool air passes through the web 10 and into the first duct component 52, and across the rotating through-air roll 120 and into the second duct component 54 towards the first axis 130 of the through-air roll 120. The arrows that represent cool air are depicted without one or more channels or nozzles to localize the region of cooling on the web. FIG. 1 depicts ambient cooling air simply being draw by negative pressure from the environment in which the system is assembled, through the web and the downstream ducting. One of skill in the art will recognize that one or more channels and/or nozzles may be provided which are useful for focusing the incoming cooling air, in the area of the arrows in FIG. 1, for the purpose of optimizing the process. As shown, the cooling system 50 may also include a third duct component 56 that extends inside of the through-air roll 120 along the first axis 130 (i.e. axis of rotation of the roll 120). It should be appreciated that the second and third duct components 54, 56 may be part of a stationary baffle system inside of the through-air roll 120. Prior art embodiments in which cooling air passes through the web may have ducting systems internal to the through-air roll differing from those described herein.

The Applicant recognized problems associated with the conventional through-air apparatus 100 shown in FIG. 1. In particular, the inventor recognized that with the conventional cooling system shown in FIG. 1, it was difficult and time consuming to access the components of the cooling system that were inside of the through-air roll. As mentioned above, the second and third duct components 54, 56 are positioned inside of the through-air roll 120. Conventional cooling systems 50, such as the one shown in FIG. 1, typically require frequent cleaning, seal adjustments and other general maintenance of the components inside of the through-air roll 120. However, it may be difficult to access these confined spaces in the interior of the through-air roll 120. As set forth in more detail below, aspects of the present disclosure are directed to a new cooling system where all of the cooling system is external to the through-air apparatus.

The Applicant contemplated that the present disclosure may have a variety of advantages. First, a configuration where all of the cooling system is external to the through-air roll 120 enables all of the components of the cooling system to be more easily accessed for cleaning and maintenance, as entering the through-air roll is not required. Second, a configuration where all of the cooling system is external to the through-air roll 120 may also improve the energy efficiency of the through-air apparatus. In particular, by separating all of the components of the cooling system away from the inside of the through-air roll (and the hot process air) the overall energy efficiency of the apparatus may be improved, as the cool air is less likely to mix with the warmer process air (and vice versa).

Figure 2:
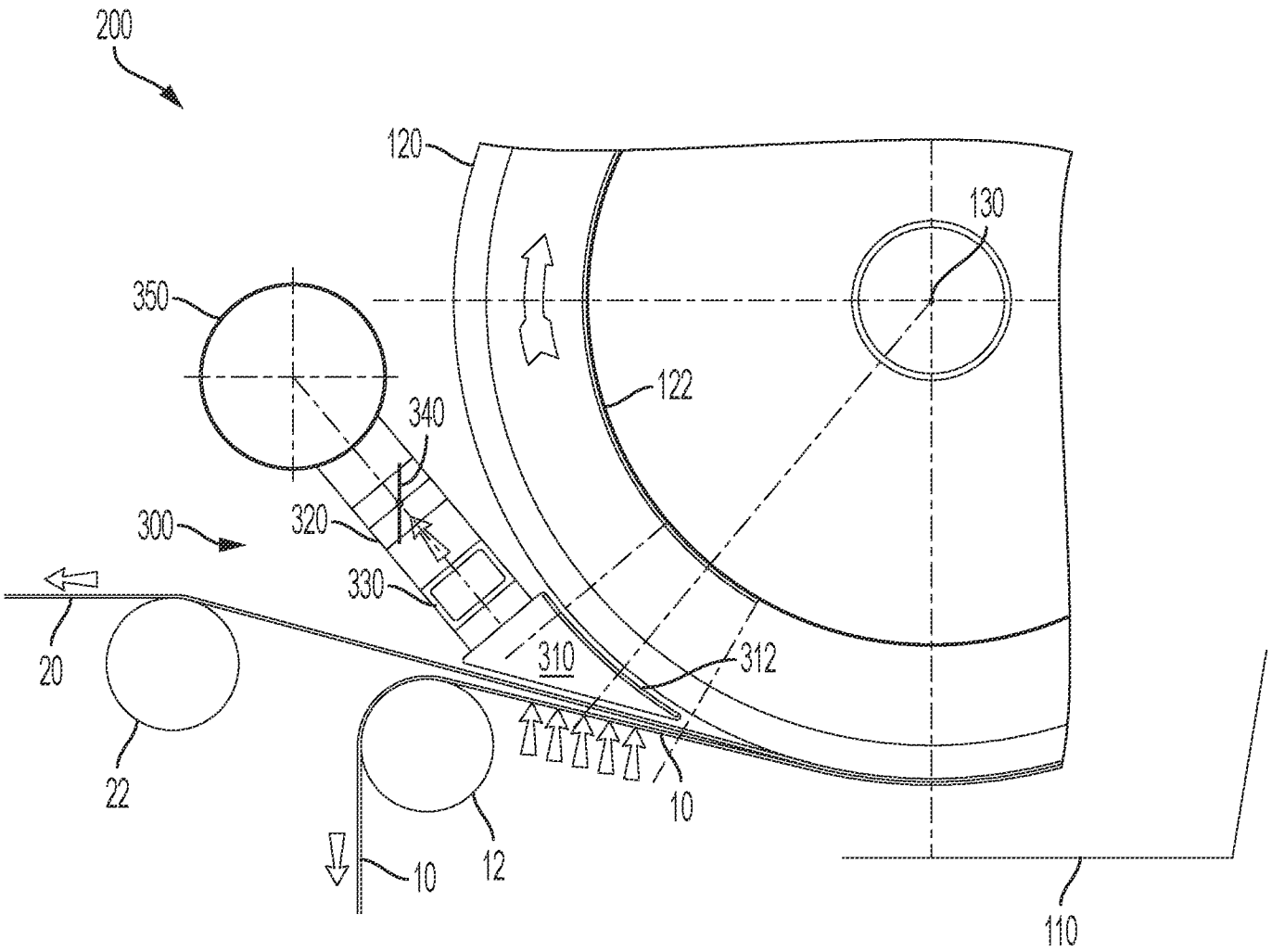
FIG. 2 is a schematic diagram of a through-air apparatus according to one embodiment which illustrates a carrying wire.

Turning now to FIG. 2, one embodiment of a through-air apparatus 200 according to the present disclosure will now be described. The through-air apparatus 200 shown in FIG. 2 has a cooling system 300 that is external to the through-air roll 120. In other words, unlike the conventional cooling system 50 shown in FIG. 1, none of the components of the cooling system 300 are positioned inside of the through-air roll 120. Further details regarding the cooling system 300 are discussed below.

The through-air apparatus 200 shown in FIG. 2 has a through-air roll 120 which is configured to rotate about a first axis 130. A through-air apparatus 200 is typically a very large machine. For example, the through-air roll 120 may have an axial length ranging from 1 foot—30 feet, and a diameter ranging from 1 foot—25 feet. The cylindrical wall of the roll 120 may be formed of an open rigid structure to permit the flow of air therethrough. In one embodiment, the through-air roll 120 may be a HONEYCOMB ROLL® obtained from Valmet, Inc.

As shown, a hood 110 at least partially encloses the through-air roll 120. One of ordinary skill in the art will appreciate that in one embodiment, the hood 110 is configured to fully enclose the through-air roll 120. In another embodiment, the hood 110 is configured to only partially enclose the through-air roll 120, as the disclosure is not limited in this respect. In one embodiment, it is contemplated that the hood may enclose from about 20° around the through-air roll 120 up to about 360° around the through-air roll 120. Furthermore, one of ordinary skill in the art will also appreciate that the through-air roll 120 and the hood 110 are typical components of a through-air apparatus and thus are not discussed in great detail.

As shown in FIG. 2, a web 10 is wrapped around the roll 120. One or more idler rolls 12 may be provided to transfer a web 10 off of the through-air roll 120. In this particular embodiment, the cooling system 300 is positioned between the through-air roll 120 and the idler roll 12.

The cooling system 300 may include one or more of the following components. First, as shown in FIG. 2, the cooling system 300 includes a wedge-shaped duct component 310. As shown, the wedge-shaped duct component 310 is adjacent the through-air roll 120 and is also external to the through-air roll 120. As shown, the shape of the wedge-shaped duct component 310 may substantially follow the radius of curvature of the through-air roll 120, so that it can be positioned at the tangent point where the web 10 separates from the roll 120. As shown in FIG. 2, the cooling system 300 may also include an exhaust duct system 320, 350 which is external to the through-air roll 120. In one illustrative embodiment, the exhaust duct system 320, 350 is downstream of the wedge-shaped duct component 310. As shown, one or more dampers 340 may be provided inside of the cooling system 300 to control the flow of the cool air. In one embodiment, one damper 340 may be used to control the overall flow rate of the cool air. In another embodiment, a plurality of dampers 340 may be used to control the flow profile of the cool air. Further embodiments illustrating various air flow control dampers are also set forth in more detail below.

As shown by the representative cool air flow path arrows in FIG. 2, in one illustrative embodiment, cool air may pass up through the web 10 to cool the web 10 as it leaves the through-air roll 120. After the cool air passes through the web 10, the cool air enters into the wedge-shaped duct component 310. It should be appreciated that the bottom surface of the wedge-shaped duct component 310 has one or more openings to permit the passage of air therethrough. From the wedge-shaped duct component 310, the cool air may enter the exhaust duct system 320, 350. After the cool air passes through the exhaust duct system 320, 350 it may be vented to atmosphere.

As mentioned above, the apparatus 200 may include one or more idler rolls 12 which may assist in transfer of the web 10 onto and off of the roll 120. As shown in FIG. 2, the apparatus 200 may also include an idler roll 22 which may assist in the transfer of a carrying wire 20 onto and off of the roll 120. The idler rolls 12, 22 may or may not be driven by a motor, chain, or other mechanism. As shown, a carrying wire 20 may be configured to extend around at least a portion of the through-air roll 120 to carry the web 10. The carrying wire 20 acts as a support structure for the web 10, and as shown in FIG. 2, the carrying wire 20 is positioned between the through-air roll 120 and the web 10. As shown in FIG. 2, in one illustrative embodiment, the cooling system 300 is configured to provide cool air to the web 10 while the web 10 is still in contact with the carrying wire 20. The idler rolls 12, 22 may be positioned to separate the web 10 from the carrying wire 20 just after the cooling system 300 provides cool air to the web 10.

The specific embodiment disclosed in FIG. 2 illustrates a configuration which includes at least one blocking plate configured to prevent cool air from entering the through-air roll 120. For example, in one illustrative embodiment, the wedge shaped duct component 310 includes a blocking plate 312, and the through-air roll 120 may also include a blocking plate 122. As shown, the one or more blocking plates 312, 122 may be curved pieces that match the contour of the through-air roll 120. In another embodiment, the blocking plates 312, 122 may have a different contour and may also be flat. In the embodiment illustrated in FIG. 2, the blocking plate 312 on the wedge-shaped duct component 310 prevents the cool air that passes into the duct component 310 from passing into the through-air roll 120. In this embodiment, the blocking plate 312 is also configured to direct the cool air up into the exhaust duct system 320, 350. In one embodiment, the blocking plate 122 inside of the through-air roll 120 may be part of a stationary baffle system inside of the through-air roll 120.

As mentioned above, the cooling system 300 is configured to provide cool air to a web 10 as the web 10 leaves the through-air roll 120. The "cool air" may be defined as air that has a temperature that is lower than the drying/curing/bonding process air temperature within the through-air apparatus. In one embodiment, the temperature of the cool air may range from about 40° F. to about 300° F. In another embodiment, the temperature of the cool air may range from about 55° F. to about 80° F.

The cool air may be sourced from a variety of locations. As shown in FIG. 2, the cool air may be sourced from the air surrounding the through-air apparatus 200. The present disclosure also contemplates that the cool air may be sourced from an external source, including but not limited to air that is sourced from the outside, a chilled unit, a machine hall, and/or a moist air source. In one embodiment, the cool air may be sourced from system air from another portion of the through-air apparatus system. In one embodiment, the cool air is sourced from the exhaust line of the through-air apparatus. In one embodiment, the cool air is chilled to a temperature below room temperature (i.e. between about 60-80° F.).

As shown in FIG. 2, in one embodiment, the cooling system 300 includes a perforated plate cartridge 330 which is external to the through-air roll 120. The perforated plate cartridge 330 may be configured to adjust the air flow across the web for substantially uniform cooling. In one embodiment, the plate cartridge 330 is removable from the cooling system 300 for cleaning and maintenance. In one embodiment, the plate cartridge 330 slides in and out of the exhaust duct system 320.

Figure 3:
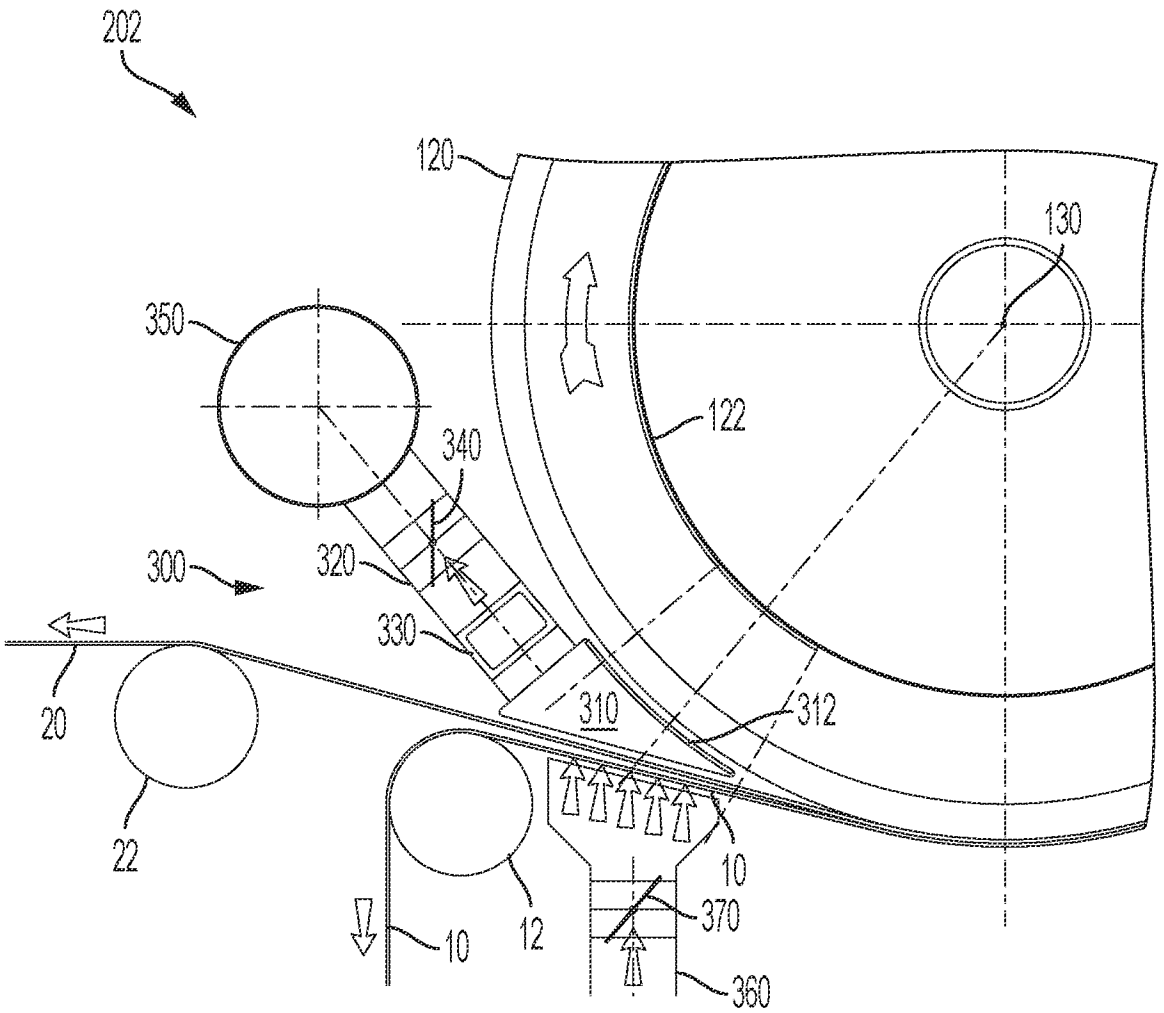
FIG. 3 is a schematic diagram of a through-air apparatus according to another embodiment which illustrates a carrying wire and a supply duct system.

FIG. 3 illustrates another embodiment of a through-air apparatus 202 according to the present disclosure. FIG. 3 is similar to the above-described through-air apparatus 200 shown in FIG. 2. Accordingly, similar components have been given identical reference numbers. Unlike FIG. 2, in which the cooling system 300 sources the cool air from the surrounding environment, in FIG. 3, the cooling system 300 further includes a supply duct system 360, which is also external to the through-air roll 120. As shown, the supply duct system 360 may include one or more dampers 370 to control the flow of the cool air through the cooling system 300. As shown in FIG. 3 by the cool air flow path arrows, in one embodiment, cool air may pass from the supply duct system 360 and through the web 10 to cool the web 10 as it leaves the through-air roll 120. As shown, after the cool air passes through the web 10, the cool air enters into the wedge-shaped duct component 310. From the wedge-shaped duct component 310, the cool air may then enter the exhaust duct system 320, 350.

It is also contemplated that in any of the embodiments described herein, one or more of the cooling system duct component 310, 320, 330, 350, 360 may include one or more seals to capture the cool air flow into the desired plenums. In one embodiment, the one or more seals may be mechanical seals, and in another embodiment for example, seals provided by an air knife, air curtain, or a stream of air are also contemplated.

As shown in FIG. 3, in one illustrative embodiment, the cooling system 300 is configured to provide cool air to the web 10 while the web 10 is still in contact with the carrying wire 20. The idler rolls 12, 22 may be positioned to separate the web 10 from the carrying wire 20 just after the cooling system 300 provides cool air to the web 10. As mentioned above, the cool air in the supply duct system 360 may be sourced from the outside, a chilled unit, a machine hall, and/or a moist air source. It should also be recognized that any of the embodiments described herein may include a supply duct system 360 as shown in FIG. 3.

Figure 4:
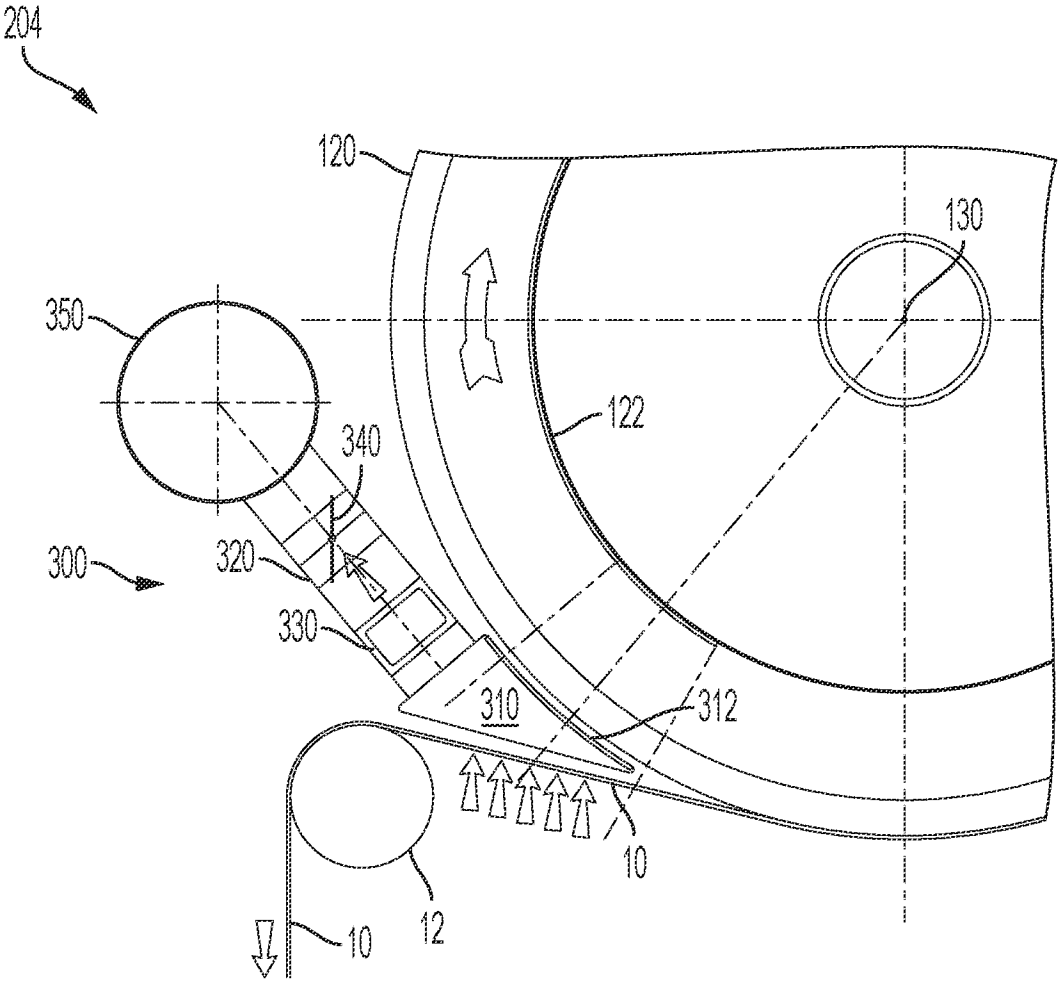
FIG. 4 is a schematic diagram of a through-air apparatus according to another embodiment.

FIG. 4 illustrates yet another embodiment of a through-air apparatus 204 according to the present disclosure. FIG. 4 is similar to the above-described through-air apparatus 200 shown in FIG. 2. Accordingly, similar components have been given identical reference numbers. Unlike FIG. 2, the through-air apparatus 204 shown in FIG. 4 does not include a carrying wire 20 or idler roll 22. Instead, the web 10 is in direct contact with the through-air roll 120. Optionally in this configuration, the roll 120 may be covered with a wire sleeve, as one of ordinary skill in the art would recognize. Thus, as the web 10 separates from the roll 120, the cooling system 300 is configured to provide cool air directly through the web (and not also through a carrying wire 20). As shown in FIG. 4 by the cool air flow path arrows, in one embodiment, cool air may pass from the surrounding environment and through the web 10 to cool the web as it leaves the through-air roll 120. After the cool air passes through the web 10, the cool air enters into the wedge-shaped duct component 310 and then through the exhaust duct system 320, 350 as described above.

Figure 5:
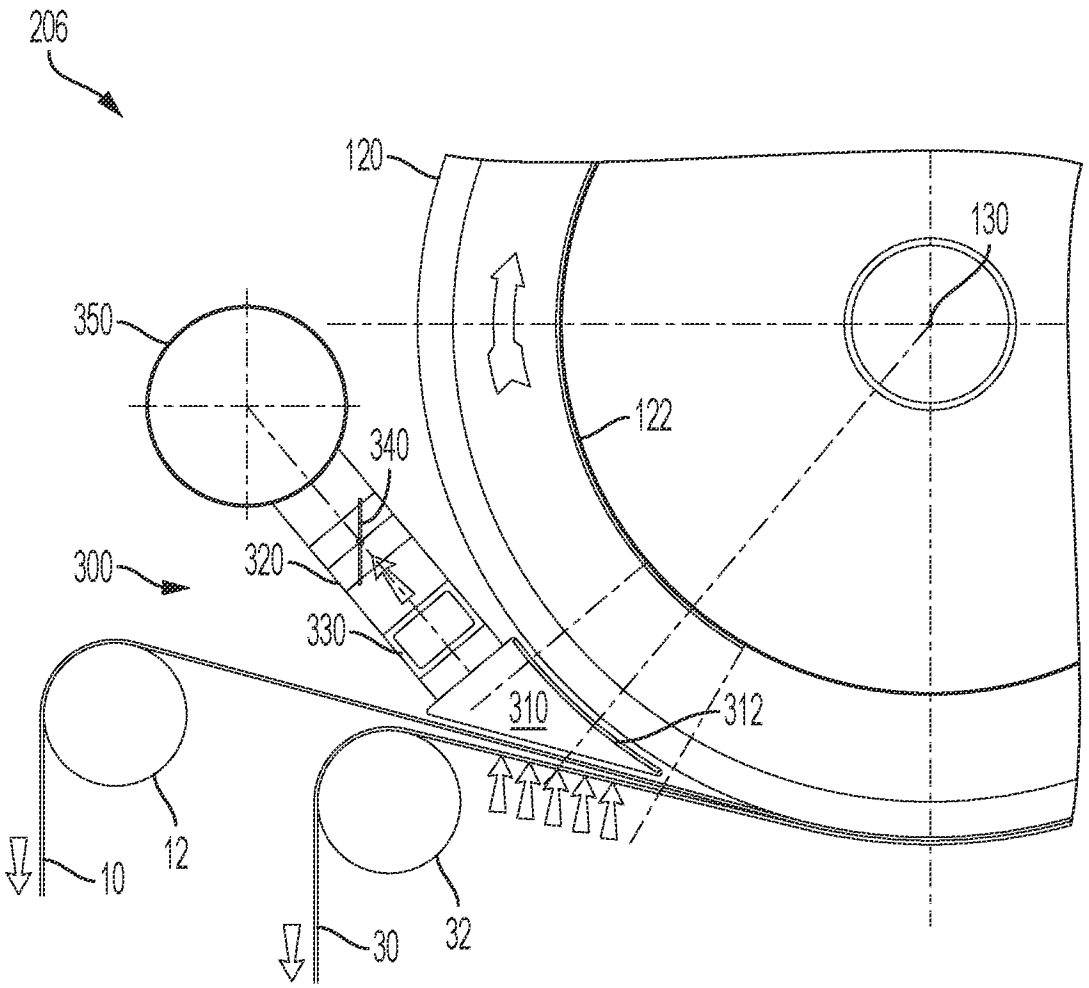
FIG. 5 is a schematic diagram of a through-air apparatus according to yet another embodiment which illustrates a restraining wire.

FIG. 5 illustrates yet another embodiment of a through-air apparatus 206 according to the present disclosure. FIG. 5 is also similar to the above-described through-air apparatus 200 shown in FIG. 2. Accordingly, similar components have been given identical reference numbers. Unlike FIG. 2, the through-air apparatus 206 shown in FIG. 5 does not include a carrying wire 20 or idler roll 22. Instead, the through-air apparatus 206 includes a restraining wire 30 which is configured to extend around at least a portion of the through-air roll 120 and over the web 10 to restrain the web 10. As shown, the web 10 is positioned between the through-air roll 120 and the restraining wire 30. Optionally in this configuration, the roll 120 may be covered with a wire sleeve, as one of ordinary skill in the art would recognize. In one illustrative embodiment, the through-air apparatus 206 may also include one or more idler rolls 32 which may assist in the transfer of the restraining wire 30 onto and off of the roll 120. As shown in FIG. 5, in one illustrative embodiment, the cooling system 300 is configured to provide cool air to the web 10 while the web 10 is still in contact with the restraining wire 30. The idler rolls 12, 32 may be positioned to separate the web 10 from the restraining wire 30 just after the cooling system 300 provides cool air to the web 10. After the cool air passes through the web 10, the cool air enters into the wedge-shaped duct component 310. From the wedge-shaped duct component 310, the cool air may then enter the exhaust duct system 320, 350.

Figure 6:
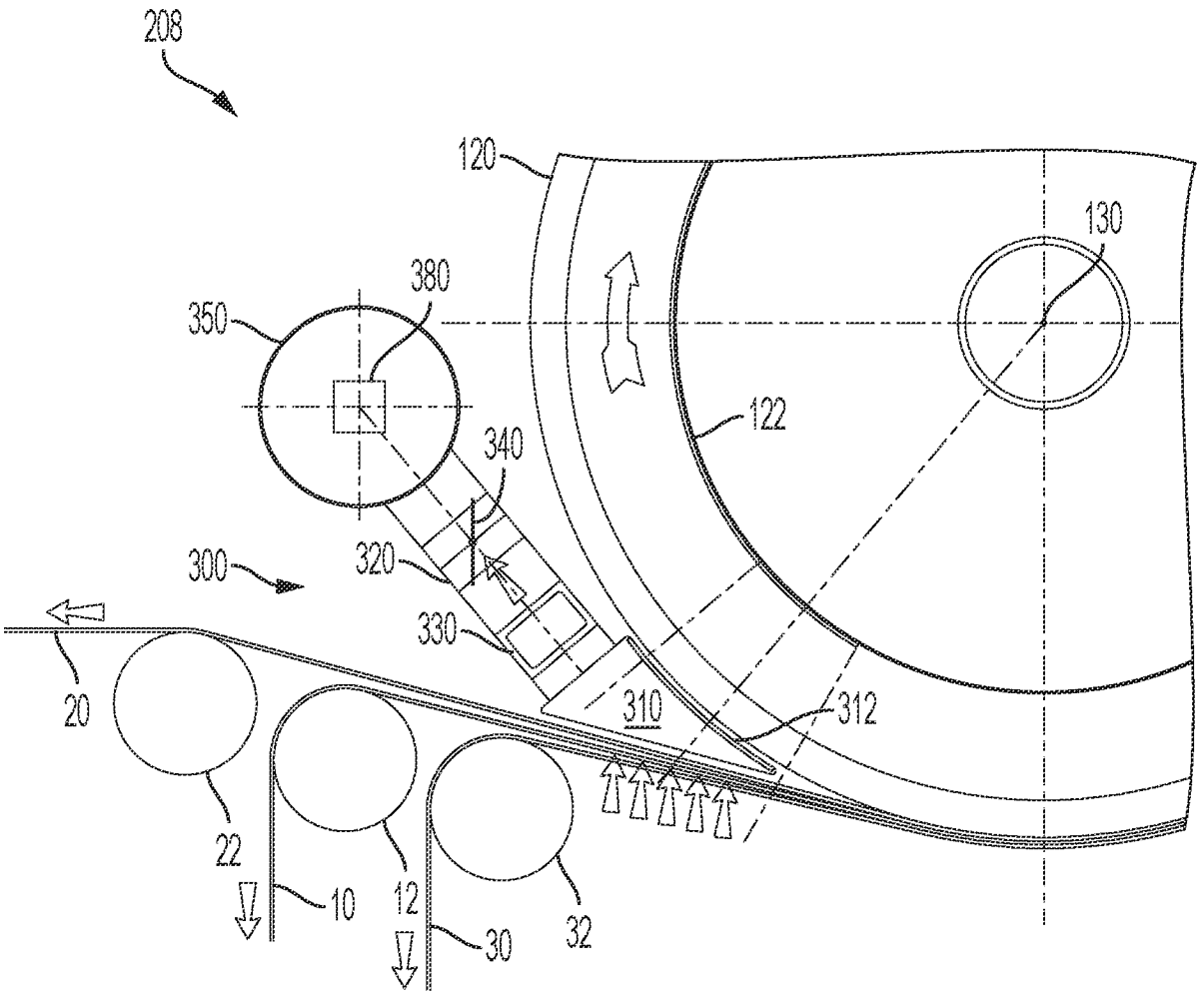
FIG. 6 is a schematic diagram of a though-air apparatus according to one embodiment which illustrates a carrying wire and a restraining wire.

FIG. 6 illustrates another embodiment of a through-air apparatus 208 according to the present disclosure. FIG. 6 is also similar to the above-described through-air apparatus shown in FIGS. 2-5. Accordingly, similar components have been given identical reference numbers. However, the through-air apparatus 208 shown in FIG. 6 includes both a carrying wire 20 and a restraining wire 30. As shown, the web 10 is positioned between the carrying wire 20 and the restraining wire 30, and the cooling system 300 is configured to provide cool air to the web 10 while the web 10 is in contact with both the carrying wire 20 and the restraining wire 30.

As shown in FIG. 6 by the cool air flow path arrows, in one embodiment, cool air may pass from the surrounding environment and through the restraining wire 30, web 10, and carrying wire 20 to cool the web 10 as it leaves the through-air roll 120. It should also be recognized that in one embodiment, the embodiment shown in FIG. 6 may also include a supply duct system 360. After the cool air passes through the web 10, the cool air enters into the wedge-shaped duct component 310. From the wedge-shaped duct component 310, the cool air may then enter the exhaust duct system 320, 350.

In one illustrative embodiment, the cooling system 300 includes a fan 380 configured to direct cool air onto the web or pull cool air through the web 10 as the web 10 leaves the through-air roll 120. As shown in FIG. 6, in one embodiment, the fan 380 is positioned within the exhaust duct system 320, 350. One of ordinary skill in the art will appreciate that in another embodiment, one or more fans 380 may be positioned in different locations within the cooling system 300 to cause the cool air to move desirably through the cooling system 300 and also across the web 10. For example, in one embodiment that includes a supply duct system 360, such as the embodiments shown in FIGS. 3 and 7, a fan (not shown) may be positioned in the supply duct system 360. Also, in one embodiment, the fan speed may be adjusted to control the cool air flow through the cooling system 300.

Figure 7:
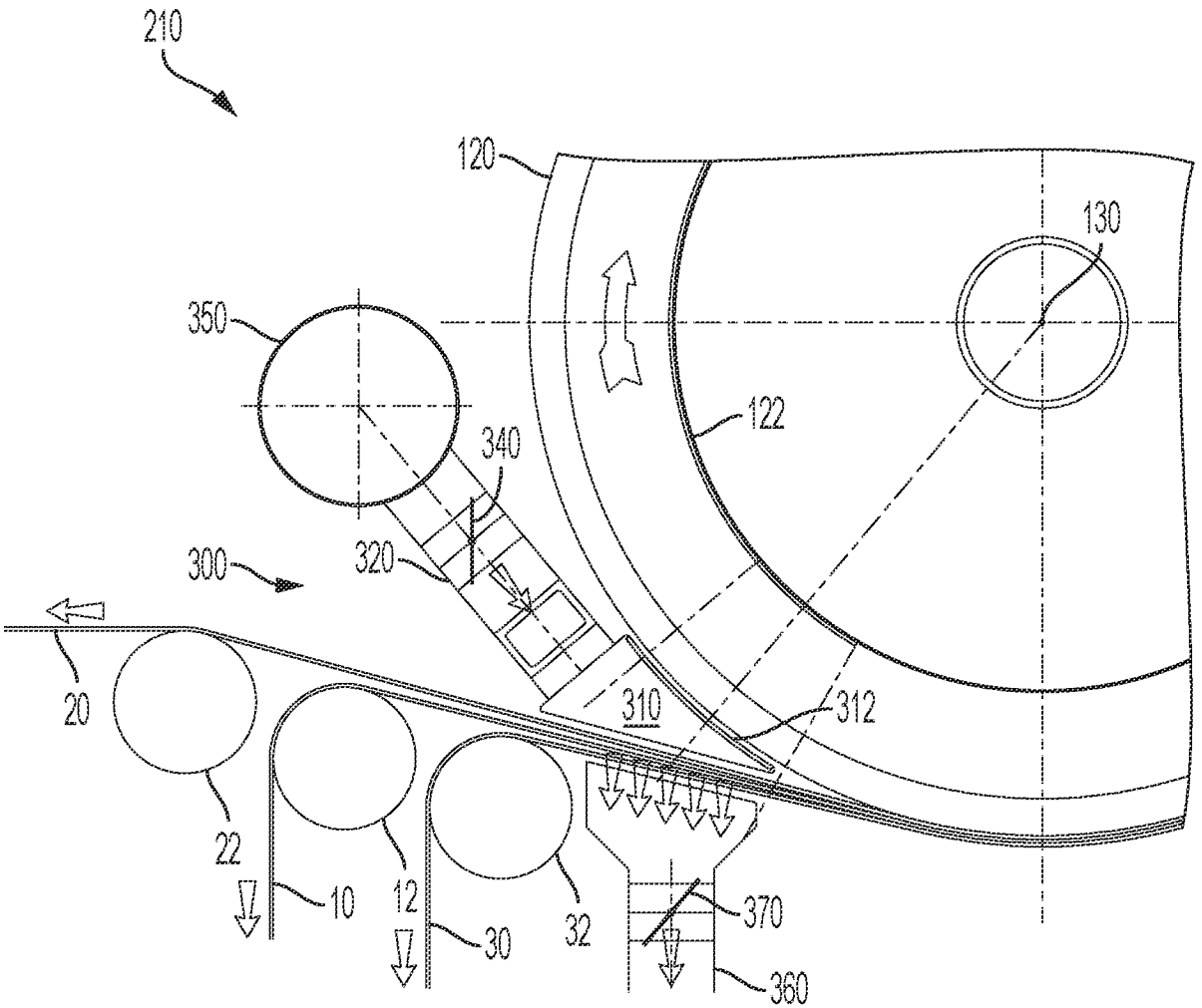
FIG. 7 is a schematic diagram of a though-air apparatus according to yet another embodiment in which the cool air flow through the cooling system is in the opposite direction from the earlier described embodiments.
Figure 8:
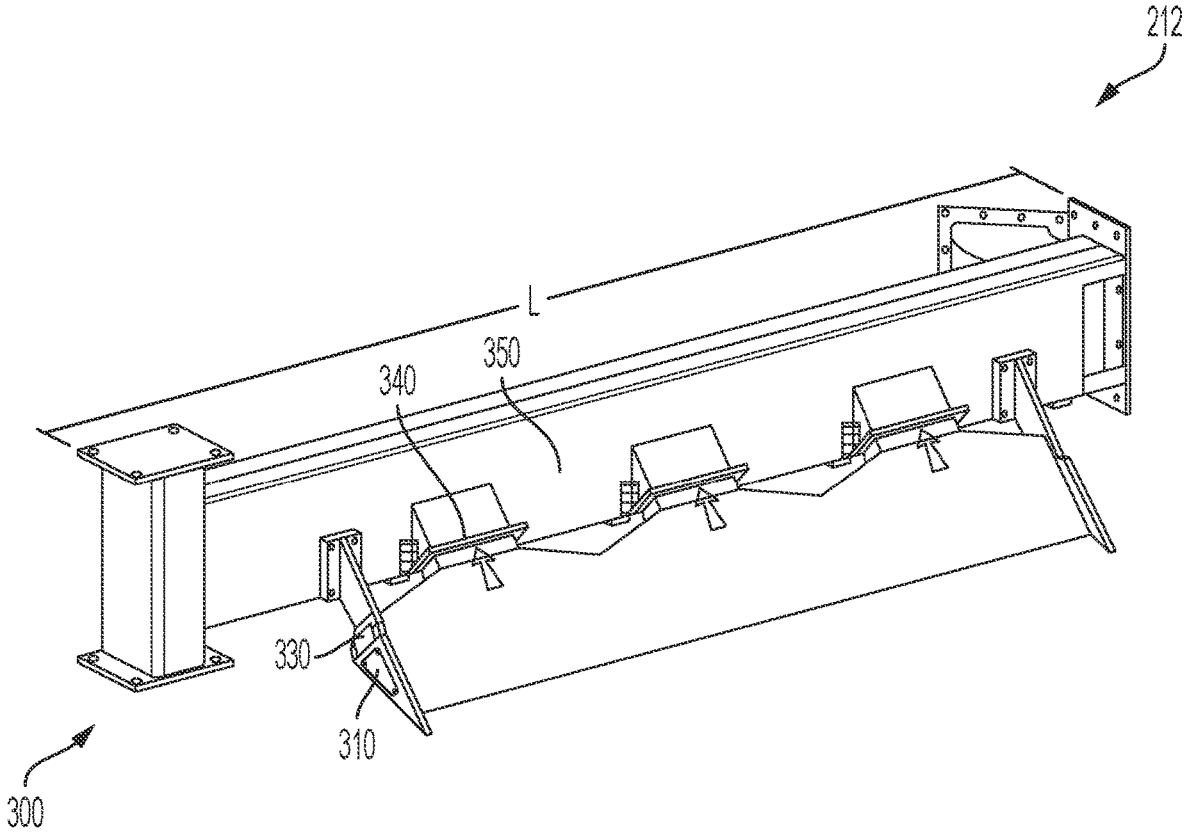
FIG. 8 is a perspective view of a portion of a through-air apparatus according to yet another embodiment that illustrates a cross beam exhaust header.

Furthermore, the embodiment shown in FIGS. 2-6 all illustrate configurations where the cool air flows in the same upward direction. The present disclosure also contemplates other cool air flow paths as the disclosure is not limited in this respect. For example, FIG. 7 illustrates an embodiment with a different cool air flow path. In FIG. 7, the through-air apparatus 210 is similar to the above-described embodiments. Accordingly, similar components have been given identical reference numbers. However, in the through-air apparatus 210 shown in FIG. 7, the cool air flow path is in the opposite downward direction. In this configuration the duct systems 320, 350 act as the supply duct system and the duct system 360 acts as the exhaust duct system, as the disclosure is not so limited. As shown, the cool air flows through the supply duct system (duct systems 320, 350) and also in the opposite direction through the wedge-shaped duct component 310 to provide cool air to the web 10 as the web leaves the through-air roll 120. After the cool air passes through the web 10, the cool air enters into the exhaust duct component 360. From there, the cool air may then continue through additional exhaust duct systems and it may be vented to atmosphere. As shown, the cooling system 300 includes one or more air flow control dampers 340, 370 to control the flow of cool air or the uniformity of air flow through the cooling system 300. In this air flow arrangement illustrated in FIG. 7, a restraining wire 30 and a carrying wire 20 are both shown. It is also contemplated that in another embodiment, the web 10 may be carried on the through-air roll 120 without the restraining wire 30 and/or the carrying wire 20, as the disclosure is not so limited. Optionally, the roll 120 may be covered with a wire sleeve, as one of ordinary skill in the art would recognize FIG. 8 illustrates yet another embodiment of a through-air apparatus 212. In some respects, the through-air apparatus 212 is similar to the above-described embodiments. Accordingly, similar components have been given identical reference numbers. As shown, the cooling system 300 includes a wedge-shaped duct component 310. For simplicity, the through-air roll 120 is not included in FIG. 8. However, one of ordinary skill in the art would appreciate that in one embodiment, the through-air roll 120 would be positioned adjacent to and in front of the wedge-shaped duct component 310. In this particular illustrative embodiment, the cooling system 300 includes an exhaust duct system 350 which is configured as a cross beam exhaust header. In one embodiment, the cross beam exhaust header has a length L, and each end of the cross beam exhaust header may be coupled to vertical support columns on the through-air apparatus. In one embodiment, a through-air roll has a first end and second end, and the cross beam exhaust header length L may extend from the first end of the through-air roll to its second end, thus the cooling system 300 extends the length of the through-air roll. As shown in FIG. 8, in one embodiment, the cooling system 300 includes a plurality of dampers 340 spaced apart across the length of the cross beam exhaust header 350. As mentioned above, the dampers 340 may be provided to control the flow, or uniformity of flow across the machine, of the cool air through the cooling system 300. FIG. 8 also illustrates another view of the perforated plate cartridge 330 which may be configured to adjust the air flow across the web for substantially uniform cooling and may also be removable from the cooling system 300 for cleaning and maintenance.

It is contemplated that the above-described concepts can be incorporated into a new through-air apparatus. The inventor also contemplated that these above-described concepts can be retrofitted onto an existing through-air apparatus. In other words, one could retrofit an existing through-air apparatus, such as the one shown in FIG. 1, and alter it so that it has a cooling system 300 that is external to the through-air roll 120, as shown in the embodiments illustrated in FIGS. 2-8.

Although several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto; the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A through-air apparatus for drying, curing, or bonding paper or non-woven products, the apparatus comprising:

a through-air roll configured for rotational movement about a first axis, the through-air roll configured to carry a web;

a hood at least partially enclosing the through-air roll;

a cooling system positioned adjacent the through-air roll, wherein the cooling system is configured to provide cool air to a web as the web leaves the through-air roll, wherein the cooling system is external to the through-air roll;

wherein the cooling system includes a substantially wedge-shaped duct component adjacent the through-air roll, wherein the substantially wedge-shaped duct component is external to the through-air roll;

wherein the through air-roll has a detachment point defined as where the web is configured to separate from the through-air roll, and wherein the wedge-shaped duct component is positioned after the detachment point; and wherein a first surface of the substantially wedge-shaped component is adjacent to a portion of the web after the web leaves the through-air roll, and a second surface of the substantially wedge-shaped component is adjacent to a portion of the through-air roll which does not include the web.

2. The through-air apparatus of claim 1, wherein the cooling system includes one or more dampers coupled to the substantially wedge-shaped duct component, wherein the one or more dampers is external to the through-air roll.

3. The through-air apparatus of claim 1, wherein at least one of the wedge-shaped duct component and the through-air roll includes a blocking plate configured to prevent cool air from entering the through-air roll.

4. The through-air apparatus of claim 1, further comprising a carrying wire configured to extend around at least a portion of the through-air roll to carry the web, wherein the carrying wire is positioned between the through-air roll and the web, and wherein the cooling system is configured to provide cool air to the web while the web is in contact with the carrying wire.

5. The through-air apparatus of claim 1, further comprising a restraining wire configured to extend around at least a portion of the through-air roll to restrain the web, wherein the web is positioned between the through-air roll and the restraining wire, and wherein the cooling system is configured to provide cool air to the web while the web is in contact with the restraining wire.

6. The through-air apparatus of claim 4, further comprising a restraining wire configured to extend around at least a portion of the through-air roll to restrain the web, wherein the web is positioned between the carrying wire and the restraining wire, and wherein the cooling system is configured to provide cool air to the web while the web is in contact with the carrying wire and the restraining wire.

7. The through-air apparatus of claim 1, wherein the cooling system includes a supply duct system, wherein the supply duct system is external to the through-air roll.

8. The through-air apparatus of claim 7, wherein the supply duct system includes one or more dampers.

9. The through-air apparatus of claim 1, wherein the cooling system includes an exhaust duct system, wherein the exhaust duct system is external to the through-air roll.

10. The through-air apparatus of claim 9, wherein the exhaust duct system is configured as a cross beam exhaust header, wherein the cross beam exhaust header is external to the through-air roll.

11. The through-air apparatus of claim 1, wherein the cooling system includes an air flow control damper, wherein the air flow control damper is external to the through-air roll.

12. The through-air apparatus of claim 1, wherein the cooling system includes a perforated plate cartridge, wherein the perforated plate cartridge is external to the through-air roll.

13. The through-air apparatus of claim 12, wherein the perforated plate cartridge is removable from the cooling system for cleaning.

14. The through-air apparatus of claim 1, further comprising an idler roll adjacent the through-air roll, wherein the idler roll is configured to transfer a web off of the through-air roll, wherein the cooling system is positioned between the through-air roll and the idler roll.

15. The through-air apparatus of claim 1, wherein the through-air roll has a first end and a second end, and wherein the cooling system extends substantially from the first end of the through-air roll to the second end of the through-air roll.

16. The through-air apparatus of claim 1, wherein the apparatus is configured as a through-air dryer (TAD), configured for drying or curing the web.

17. The through-air apparatus of claim 1, wherein the apparatus is configured as a through-air bonder (TAB).

18. The through-air apparatus of claim 1, wherein the cooling system includes at least one fan configured to direct cool air onto the web or pull cool air through the web as the web leaves the through-air roll.

19. The through-air apparatus of claim 1, wherein the cooling system is configured to provide cool air from the air surrounding the through-air apparatus.

20. The through-air apparatus of claim 1, wherein the cooling system is configured to provide cool air from an external source.

* * * * *